US006151055A

United States Patent [19]

Ackley et al.

[11] Patent Number: 6,151,055

[45] Date of Patent: Nov. 21, 2000

[54] MULTI-MEDIA THERMAL PRINTER

[75] Inventors: H. Sprague Ackley, Seattle; Pixie A. Austin, Marysville, both of Wash.

[73] Assignee: Intermec IP Corp., Woodland Hills, Calif.

[21] Appl. No.: 09/250,827

[22] Filed: Feb. 17, 1999

Related U.S. Application Data

[63] Continuation-in-part of application No. 08/722,745, Oct. 1, 1996.

[51] Int. Cl.[7] ..... B41J 2/32

[52] U.S. Cl. ..... 347/215; 101/288; 400/621

[58] Field of Search ..... 347/215; 101/288; 400/621; 156/354

[56] References Cited

U.S. PATENT DOCUMENTS

| | | |
|---|---|---|
| 4,558,963 | 12/1985 | Applegate et al. . |
| 4,657,418 | 4/1987 | Lahr . |
| 4,812,063 | 3/1989 | Kunimitsu et al. . |
| 4,860,025 | 8/1989 | Berson et al. . |
| 4,878,773 | 11/1989 | Mazumder . |
| 4,919,555 | 4/1990 | Kikuchi . |
| 4,934,847 | 6/1990 | Shiozaki et al. . |
| 4,949,098 | 8/1990 | Gluck et al. . |
| 4,953,994 | 9/1990 | Shiozaki et al. . |
| 4,973,985 | 11/1990 | Genno et al. . |
| 4,974,977 | 12/1990 | Morgan et al. . |
| 4,982,202 | 1/1991 | Buan et al. . |
| 5,032,032 | 7/1991 | Chu et al. . |
| 5,040,461 | 8/1991 | Van-Ocker . |
| 5,061,946 | 10/1991 | Helmbold et al. . |
| 5,122,882 | 6/1992 | Ishida et al. . |
| 5,322,380 | 6/1994 | Crocker . |
| 5,335,837 | 8/1994 | Saeki et al. . |
| 5,372,439 | 12/1994 | Poole et al. . |
| 5,492,423 | 2/1996 | Smith . |
| 5,560,293 | 10/1996 | Boreali et al. . |

FOREIGN PATENT DOCUMENTS

| | | |
|---|---|---|
| 0 294 792 | 12/1988 | European Pat. Off. . |
| 0 500 008 | 8/1992 | European Pat. Off. . |
| 55-32603 | 3/1980 | Japan . |
| 58-201686 | 11/1983 | Japan . |
| 60-18362 | 1/1985 | Japan . |
| 60-187570 | 9/1985 | Japan . |
| 61-116568 | 6/1986 | Japan . |
| 61-135773 | 6/1986 | Japan . |
| 62-181168 | 8/1987 | Japan . |
| 2-305666 | 12/1990 | Japan . |
| 3-178457 | 8/1991 | Japan . |

*Primary Examiner*—Huan Tran
*Attorney, Agent, or Firm*—O'Melveny & Myers LLP

[57] ABSTRACT

A thermal printer is provided which is adapted for printing information onto multiple types of print media, including both a conventional print media and a linerless print media. The thermal printer comprises a mechanism that transports the print media through a print region of the printer, which comprises a thermal print head and a rotatable platen disposed such that the print media is transported therebetween. A coating is provided on selected portions of the transporting mechanism and the platen. The coating comprises an epoxy resin mixed with a powder to provide a textured surface. The powder of the coating further comprises at least one of titanium dioxide, silica, and calcium sulfate. The coating has a film thickness ranging from approximately 2.5 to 3.5 mils. The textured surface provides sufficient friction and non-stick characteristics to permit the printer to effectively transport both conventional print media and linerless print media.

20 Claims, 2 Drawing Sheets

MULTI-MEDIA THERMAL PRINTER

RELATED APPLICATION

This application is a continuation-in-part of co-pending application Ser. No. 08/722,745 Oct. 1, 1996 for U -MEDIA THERMAL PRINTER.

BACKGROUND OF THE INVENTION

1. Field of the Invention

The present invention relates to thermal printing, and more particularly, to a thermal printer that can operate with both conventional linered and linerless print media.

2. Description of Related Art

In the field of bar code symbology, parallel bars of varying thicknesses and spacing are used to convey information, such as an identification of the object to which the bar code is affixed. To read the bar code, the bars and spaces are scanned by a moving light source, such as a laser, or imaged by an optically imaging element, such as a charge coupled device. Since the bars and spaces have differing light reflective characteristics, the information contained in the bar code can be read by interpreting the light that reflects from the bar code, or the image pattern that contains the bar code.

Bar codes are often printed onto a print media that can be associated with or affixed to the objects intended to be identified. The print media typically comprises a face material onto which the bar code is printed and an adhesive backing layer applied to an opposite surface of the face material that permits it to be affixed to an object. The face material may be further separated into discrete labels that are laminated onto a release liner having a low-stick surface that allows the labels to be removed easily. After the information is printed onto the face material, the user can simply peel off the individual labels from the release liner, and apply the labels onto an object of interest. Alternatively, the print media may include a non-adhesive card or tag stock having a texture similar to the release liner of the adhesive-backed print media. Such print media may include perforation lines to separate individual tags or cards following printing of information thereon, and a tear bar of the printer may further facilitate separation of the tags or cards. These various types of print media are referred to collectively herein as conventional print media.

In order to accurately read the bar code, it is thus essential that the bar code be printed in a high quality manner, without any streaking or blurring of the bar code, or misplacement of the bar code due to transportation of the print media at a non-uniform rate. Moreover, it is essential that the adhesive backing layer of the print media not be damaged by heat generated during the printing process, otherwise the media will not stick properly to the object. In view of these demanding printing requirements, bar codes are often printed using direct thermal or thermal transfer printing techniques. In direct thermal printing, the face material of the print media is impregnated with a thermally sensitive chemical that is reactive upon exposure to heat for a period of time. Thermal transfer printing requires an ink ribbon that is selectively heated to transfer ink to the face material. These printing techniques are referred to collectively herein as thermal printing. To print the bar code symbols, the print media is drawn past a thermal print head having linearly disposed printing elements that extend across a width of the print media. The printing elements are selectively activated in accordance with instructions from a controller to heat localized areas of the substrate or ink ribbon, thereby creating a dark image by a chemical reaction brought on by the heat. As the labels are drawn through a print region between a platen and the thermal print head, the bar code is printed onto the face material. Other images, such as text, graphics or characters, can also be printed in the same manner.

In a relatively new formulation of print media, the release liner is eliminated altogether, and the media is simply wound onto itself with the adhesive backing layer adhering directly to the face material of subsequent portions of the media. This so-called "linerless" print media includes an adhesive backing layer specifically formulated to prevent formation of a permanent adhesive bond, enabling the media to be subsequently peeled off as a roll of the media unravels without damaging the face material. Linerless media is more convenient than conventional media for certain types of applications, and by eliminating the release liner, a substantial amount of waste material normally generated in the labeling process is eliminated. Also, the elimination of the release liner allows additional print media to be wound onto the supply roll, which increases the number of labels that can be printed between roll changes. The linerless media may further include perforation lines similar to that of the tag stock media described above.

A significant drawback of the linerless print media is that the adhesive backing layer tends to form adhesive deposits on various internal surfaces of the transporting mechanism of the printer. These adhesive deposits cling to portions of the print media as it is transported thus increasing the friction of the transport path. Moreover, the adhesive deposits collect dirt, dust and other debris within the printer that can blemish the print media. As a result of these undesirable effects, the overall performance of the printer becomes degraded. While periodic cleaning of the printer mechanism ameliorates some of these effects, it also increases the unusable time of the printer as well as the maintenance cost of operating the printer.

One method to overcome this drawback is to coat certain portions of the printer transporting mechanism, including the platen, with an elastomeric substance. The elastomeric coating provides a glossy or smooth surface that resists bonding to the adhesive backing layer. Another method for printing on linerless media is illustrated in U.S. Pat. No. 5,560,293, which discloses a fineness label printer in which certain printer parts are plasma coated to provide a non-stick, low friction coating. As a result of these non-stick, smooth coatings, the linerless media can be effectively transported through the printer without forming the undesirable adhesive deposits. Although these coatings may enable linerless media to move through a printer without sticking, these coatings are known to cause slipping or frictional problems that produce misprinted barcodes when conventional media is used in the same printer. Thus, separate printers are generally required for printing on conventional and linerless media.

Thus, it would be desirable to provide a single thermal printer that is capable of efficiently operating with both conventional and linerless print media.

SUMMARY OF THE INVENTION

In accordance with the teachings of the present invention, a thermal printer is provided which is adapted for printing information onto multiple types of print media, including both a conventional print media and a linerless print media. The thermal printer includes a mechanism that transports the print media through a print region of the printer. The print region is defined by a thermal print head and a rotatable platen disposed such that the print media is transported therebetween. The thermal print head further comprises a plurality of print head elements adapted to selectively activate portions of the print media as the print media is transported through the print region.

In the present invention, a coating is provided on selected portions of the transporting mechanism. In a preferred embodiment of the present invention, the coating comprises an epoxy resin mixed with a powder to provide a rough textured surface, similar to a coarse sand paper. The powder may comprise at least one of titanium dioxide, silica, and calcium sulfate. The coating may have a film thickness ranging from approximately 2.5 to 3.5 mils. The textured surface provides sufficient friction and non-stick characteristics to permit the printer to effectively transport both conventional linered print media and linerless print media. Preferably, the coating is provided on a media guide that defines a transport path for the print media to the print region, a tear bar or other cutting device disposed downstream of the print region having an edge to provide for separation of printed portions of the print media, and a media rest disposed downstream of the print region having a rounded surface to provide a resting point for separated portions of the print media.

A more complete understanding of the multi-media thermal printer will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for a single direct thermal or thermal transfer printer that is capable of efficiently operating with both conventional and linerless print media. In the detailed description that follows, like element numerals are used to describe like elements in one or more of the figures.

Figure 1:
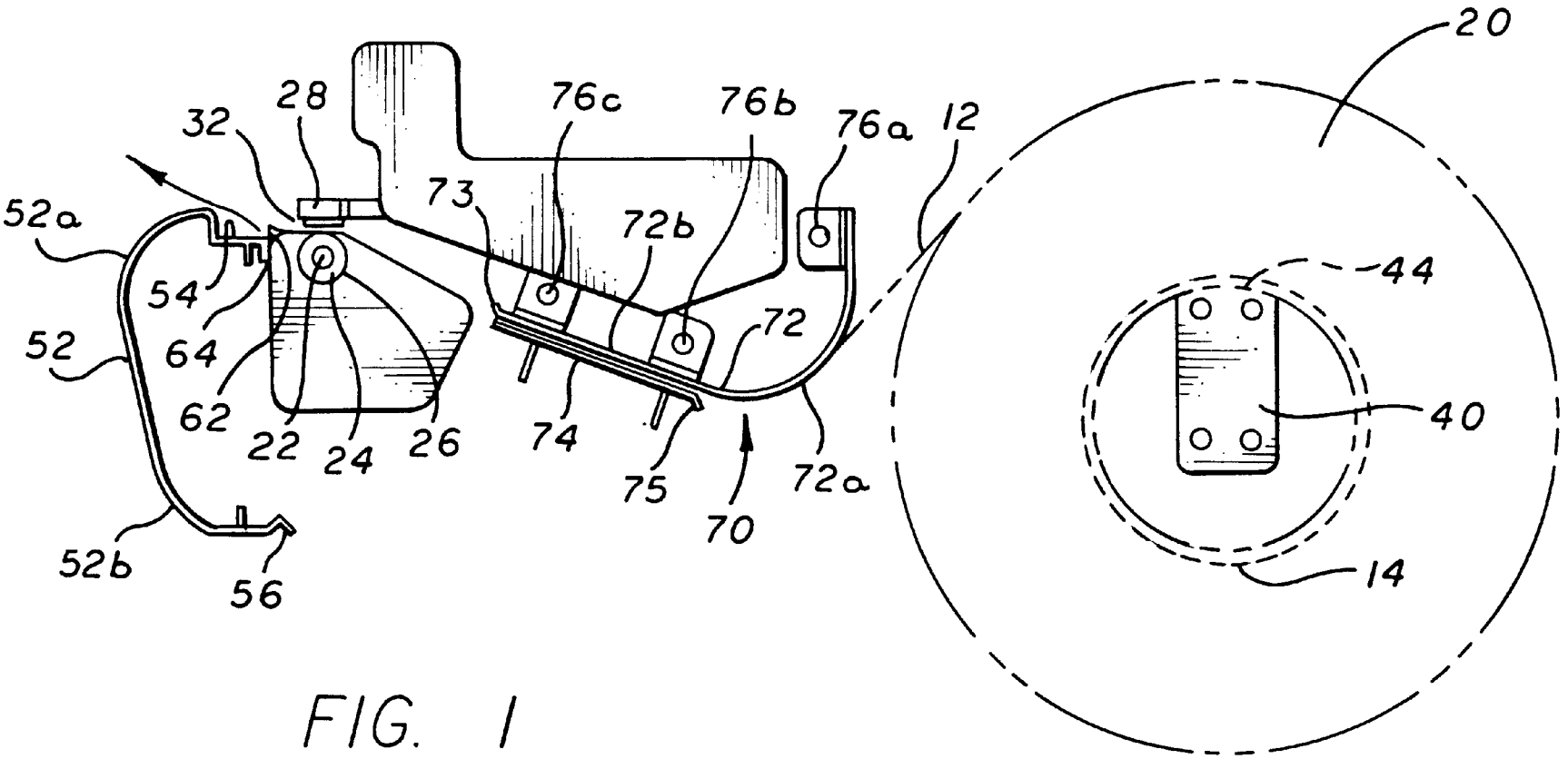
FIG. 1 is a side view of a mechanism for transporting a print media within a multi-media thermal printer in accordance with the present invention.
Figure 2:
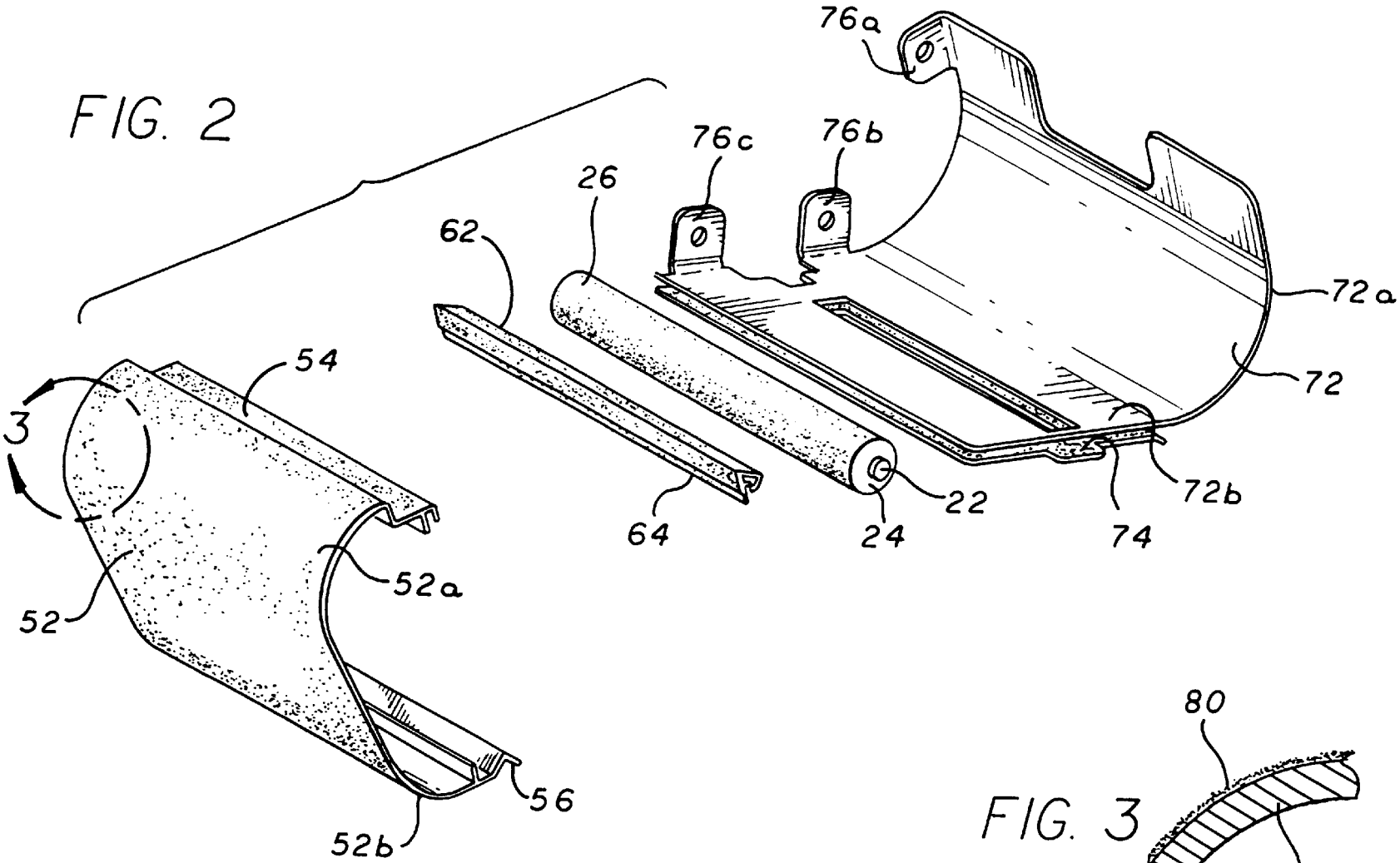
FIG. 2 is a perspective view of the printer transport mechanism.

Referring to FIGS. 1 and 2, a print media transporting mechanism for a direct thermal printer is illustrated. The illustrated transporting mechanism is similar to that used for thermal transfer printing, except that a thermal transfer printer would also require a transporting mechanism to control movement of an ink ribbon. Since those aspects of a thermal transfer printer are otherwise not pertinent to the present invention, further description herein is omitted for simplicity. Nevertheless, it should be appreciated that the teachings of the present invention are applicable to thermal transfer printing as well as direct thermal printing.

The printer includes a platen 24 having a protruding end axle 22 and a roller surface 26. In the preferred embodiment, the platen roller 24 is made of high release silicon, providing the roller surface 26 with both non-stick and high friction attributes. The axle 22 provides for support of the platen 24 at opposite ends thereof. The platen 24 is rotatable about the axle 22 by use of an external driving force, such as provided by a stepper motor driven gear and/or belt. A thermal print head 28 is disposed adjacent to the platen 24, and has linear print elements disposed along a surface 32 that faces the roller surface 26. A print region is defined between the surface 32 of the thermal head 28 and the roller surface 26 of the platen 24. As known in the art, the print head 28 receives electrical signals from a controller within the printer that control the sequence of activation of the individual print elements to effect the printing of desired information onto a print media. Rotation of the platen 24 under control of the external driving force will draw the print media through the print region.

A supply hub 40 extends substantially parallel to the platen 24 and has a rounded upper surface 44 that supports a roll of print media 20. The rounded upper surface 44 may include a roller that enables the print media 20 to rotate freely and accelerate rapidly in response to take-up pressure applied by the platen 24. A bearing may be disposed at ends of the roller to reduce the rotating resistance of the roller. The media roll 20 can be placed onto the rounded upper surface 44 with the hub 40 disposed entirely within the core 14. The hub 40 can accommodate varying sizes of print media rolls 20.

The print media roll 20 comprises a web of print media material wound onto a core 14. As described previously, the print media may be of the conventional type having a paper substrate surface layer impregnated with a thermally active chemical that reacts with heat provided by the thermal head to permit the printing of information thereon. The surface layer may further contain perforations or other types of separation lines that permit the print media web to be subdivided into individually removable labels, cards or tags. The conventional print media may further have an adhesive layer disposed on a rear surface thereof, with a removable backing layer covering the adhesive layer. The adhesive layer enables the individual labels to be removed and applied to an object of interest. Alternatively, the print media may be of the linerless type in which an adhesive layer is disposed on a rear surface of a surface layer, but in which no backing layer is provided. The linerless media is wound such that the adhesive layer adheres directly to the surface layer of a subsequent portion of the print media web.

At an outside diameter of the roll 20, the web 12 of the print media trails off the roll and is drawn toward the print region by operation of the platen 24. A guide 70 is disposed between the print region and the hub 40 and defines a path along which the print media 12 travels. The guide 70 includes an upper guide portion 72 and a lower guide portion 74, which each have a width substantially equal to or greater than a maximum width of the print media 12. The upper guide portion 72 further includes a curved portion **72*a* that transitions the direction of travel of the print media web 12 as it passes from the roll 20 to the print region, and a linear portion 72*b* that is oriented directly toward the print region. The lower guide portion 74 is shorter in length than the upper guide portion 72, and extends in parallel to the linear portion 72*b* of the upper guide portion. A gap is defined between the upper guide portion 72 and the lower guide portion 74 that permits the print media web 12 to travel therethrough. A leading edge 75 of the lower guide portion 74 flares downward slightly to enlarge the entrance to the gap, and a trailing edge 73 of the upper guide portion 72** flares upward slightly to enlarge the outlet from the gap. A plurality of mounting flanges 76*a–c* extend from a side edge of the upper guide portion 72 that permit the guide to be rigidly secured to a mounting surface of the printer.

Downstream of the thermal print head 28 and the platen 24, a tear bar 62 and a media rest 52 are provided. The tear bar 62 has a generally triangular shape in cross-section, and is elongated to extend entirely across the path of the transported print media web 12. The tear bar 62 has a cutting edge 64 provided at a downward facing corner thereof. The print media web 12 is transported below the cutting edge 64 and outwardly of the printer transporting mechanism. An operator of the thermal printer may separate individual labels or tags of the print media web 12 along a perforation line of the print media by pulling the upwardly on the web as it is discharged from the printer to force the web into the cutting edge 64. Alternatively, a cutter having a rotary blade or knife may be utilized to separate a continuous strip of print media into distinct labels.

The media rest 52 is disposed on an outer surface of the thermal printer, and provides a resting point for individual ones of the linerless labels to rest against following a printing operation and prior to removal by an operator of the thermal printer. The media rest 52 has a generally convex shape, and includes a shoulder region 54 at a top portion thereof, an upper curved portion 52*a*, a lower curved portion 52*b*, and an elongated indentation 56 at a bottom portion thereof. The shoulder region 54 is disposed adjacent to the tear bar 62, and provides a portion of the transport path for the media immediately following the tear bar. The media rest 52, including the upper and lower curved portions 52*a*, 52*b*, provides a broad surface to which the linerless labels may rest against. The elongated indentation 56 permits the bottom of the media rest 52 to engage an associate slot or opening at a front surface of the thermal printer. The media rest 52 may thus be removably attached to the thermal printer, and may be secured in place by the inherent spring bias of the media rest. It should be appreciated that the media rest 52 may be selectively installed for printing of linerless media and removed for printing of conventional media, or may be installed for both operations. Particularly, the media rest 52 may not be used when a cutter is employed to separate labels of the print media web 12.

In order to use the print media transporting mechanism effectively with either conventional or linerless print media, a preferred embodiment of the transporting mechanism includes selected portions that are provided with a coating. The coating comprises an epoxy resin that is mixed with a selected powder to provide a coarse textured surface having sufficient friction and non-stick characteristics to permit the thermal printer to effectively transport both conventional print media and linerless print media. The selected powder may comprise one or more of the following substances: titanium dioxide, silica, and/or calcium sulfate. The powder may have a particle size of approximately 20–40% through 325 mesh. The physical properties of the powder coating depend on the thickness of the coating and the characteristics of the parts. Regarding the transporting mechanism described above, the coating may be applied to a film thickness ranging from approximately 2.5 to 3.5 mils. In a preferred embodiment of the present invention, the coating comprises Product No. IF 3785 by H.B. Fuller Company, though it should be appreciated that other commercially available powder coatings having similar properties can also be advantageously utilized.

The coating is applied to all surfaces of the transporting mechanism that may come into contact with the adhesive layer of the linerless print media. The coating is sprayed onto each desired surface in dry form and held electrostatically to the surface. Each part is then placed into an over to melt the powder to form a hard continuous coating. In particular, the coating should be applied to the downward facing surface of the upper guide portion 72, the upward facing surface of the lower guide portion 74, all surfaces of the tear bar 62, and all outward facing surfaces of the media rest 52. Though the downward facing surface of the upper guide portion 72 does not necessarily come into direct contact with the adhesive layer of the print media web 12 since the adhesive layer faces downward, it should be appreciated that adhesive deposits may remain on the surface layer of the print media following its unwinding from the roll 20, and these deposits may be undesirably transferred to the upper guide portion. Further, the coating applied to the downward facing surface of the upper guide portion 72 allows for easier loading of the linerless print media as well.

Figure 3:
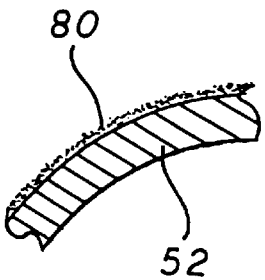
FIG. 3 is an enlarged portion of the printer transport mechanism illustrating a coating applied to enable multi-media operation.

The coating is illustrated in FIG. 2 as a shaded surface treatment of the various elements of the transporting mechanism described above. In FIG. 3 an enlarged portion of the media rest 52 is illustrated as having the coating 80 applied thereto. As illustrated, the coating 80 has a wavy surface due to the powder impregnation of the epoxy, resulting in a coarse, rough texture, similar to a coarse sandpaper. It should be appreciated that the same coating is applied to the other elements of the transporting mechanism described above, and therefore, further illustrations of the coating applied to these other elements are omitted for simplicity.

Having thus described a preferred embodiment of a multi-media thermal printer, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A multi-media thermal printer, comprising:

a media supply adapted to carry a roll of print media comprising alternatively one of a conventional media type having an inert release liner covering an adhesive surface and a linerless media type having an exposed adhesive surface;

means for transporting said roll of print media from said media supply through a print region of the printer, said transporting means further comprising a platen roller alternatively disposed in contact with said release liner of said conventional media type and said exposed adhesive surface of said linerless media type, and a media guide defining a transport path for said print media from said media supply to said print region; and a coating disposed on selected portions of said transporting means including said media guide, said coating comprising an epoxy resin mixed with powder to provide a textured surface having sufficient friction and non-stick characteristics to effectively transport alternatively said conventional print media type and said linerless print media type.

2. The multi-media thermal printer of claim 1, wherein said powder further comprises at least one of titanium dioxide, silica, and calcium sulfate.

3. The multi-media thermal printer of claim 1, wherein said selected portions of said transporting means further comprise means for separating printed portions of said print media.

4. The multi-media thermal printer of claim 3, wherein said separating means further comprises a tear bar disposed downstream of said print region having a cutting edge adapted to be brought into contact with said print media.

5. The multi-media thermal printer of claim 1, wherein said selected portions of said transporting means further comprise a media rest disposed downstream of said print region having a rounded surface to provide a resting point for separated portions of said print media.

6. The multi-media thermal printer of claim 1, wherein said coating further comprises a film thickness ranging from approximately 2.5 to 3.5 mils.

7. In a thermal printer including a platen and a media guide path for transporting a print media to a print region of the printer, an improvement comprising:

a coating, having a film thickness ranging from approximately 2.5 to 3.5 mils, provided on selected portions of said guide path, said coating comprising an epoxy resin mixed with a powder to provide a textured surface;

wherein said textured surface provides sufficient friction and non-stick characteristics to effectively transport alternatively said conventional print media type and said linerless print media type.

8. The improvement of claim 7, wherein said powder further comprises at least one of titanium dioxide, silica, and calcium sulfate.

9. A thermal printer adapted for printing information onto multiple types of print media, including a conventional print media and a linerless print media, comprising:

means for transporting said print media through a print region of said printer, said print region comprising a thermal print head and a rotatable platen disposed with said print media therebetween, said thermal print head further comprising a plurality of print head elements adapted to selectively activate portions of said print media as said print media is transported through said print region; and a coating disposed on selected portions of said transporting means, said coating comprising an epoxy resin mixed with a powder to provide a textured surface having sufficient friction and non-stick characteristics to effectively transport alternatively said conventional print media and said linerless print media.

10. The printer of claim 9, wherein said selected portions of said transporting means further comprise a media guide defining a transport path for said print media to said print region.

11. The printer of claim 10, wherein said selected portions of said transporting means further comprise a tear bar disposed downstream of said print region having an edge to provide for separation of printed portions of said print media.

12. The printer of claim 11, wherein said powder further comprises at least one of titanium dioxide, silica, and calcium sulfate.

13. The printer of claim 9, wherein said selected portions of said transporting means further comprise a media rest disposed downstream of said print region having a rounded surface to provide a resting point for separated portions of said print media.

14. The printer of claim 9, wherein said coating further comprises a film thickness ranging from approximately 2.5 to 3.5 mils.

15. The multi-media thermal printer of claim 1, wherein said powder has a particle size of approximately 20% to 40% through 325 mesh.

16. The multi-media thermal printer of claim 2, wherein said powder has a particle size of approximately 20% to 40% through 325 mesh.

17. The multi-media thermal printer of claim 15, wherein said coating further comprises a film thickness ranging from approximately 2.5 to 3.5 mils.

18. The improvement of claim 7, wherein said powder has a particle size of approximately 20% to 40% through 325 mesh.

19. The printer of claim 9, wherein said powder has a particle size of approximately 20% to 40% through 325 mesh.

20. The printer of claim 14 wherein said powder has a particle size of approximately 20% to 40% through 325 mesh.

* * * * *